US006512913B2

(12) United States Patent
Hirst et al.

(10) Patent No.: US 6,512,913 B2
(45) Date of Patent: Jan. 28, 2003

(54) FUSING SYSTEM INCLUDING A HEAT STORAGE MECHANISM

(75) Inventors: B. Mark Hirst, Boise, ID (US); Mark Wibbels, Boise, ID (US); Kenneth E. Heath, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/819,504

(22) Filed: Mar. 28, 2001

(65) Prior Publication Data

US 2002/0141797 A1 Oct. 3, 2002

(51) Int. Cl.[7] ..... G03G 15/20
(52) U.S. Cl. ..... 399/328; 219/216; 399/333
(58) Field of Search ..... 399/330, 333, 399/328; 219/216, 469; 118/60; 430/99, 124; 347/156; 492/46

(56) References Cited

U.S. PATENT DOCUMENTS 5,019,693 A * 5/1991 Tamary ..... 219/216 X
5,724,638 A * 3/1998 Isogai et al. ..... 399/333
5,789,723 A 8/1998 Hirst ..... 219/501
5,839,043 A 11/1998 Okabayashi et al. ..... 399/329
5,984,848 A 11/1999 Hyllberg et al. ..... 492/46
6,018,151 A 1/2000 Hirst ..... 219/497
6,047,158 A * 4/2000 Morigami et al. ..... 399/328
6,122,478 A 9/2000 Hirst ..... 399/330
6,154,629 A * 11/2000 Kinouchi et al. ..... 219/216 X
6,181,891 B1 1/2001 Higashi et al. ..... 399/70
6,304,741 B1 * 10/2001 Tange ..... 399/328
6,345,169 B1 * 2/2002 Haneda et al. ..... 399/328

FOREIGN PATENT DOCUMENTS

JP 09-134035 * 5/1997

* cited by examiner

*Primary Examiner*—Sophia S. Chen

(57) ABSTRACT

The present disclosure relates to a fusing system for fusing toner to a recording medium. The fusing system includes a fuser roller including an elastomeric layer and a heat transport layer disposed around the elastomeric layer, the heat transport layer having high thermal capacity, and a pressure roller in contact with the fuser roller. The present disclosure also relates to a fusing method that helps reduce gloss variation of printed media fused to a recording medium with a fusing system. The method includes the steps of forming a heat transport layer having high thermal capacity at an outer surface of a fuser roller of the fusing system, heating the heat transport layer, and transferring heat from the heat transport layer to the recording medium as it passes through a nip of the fusing system.

24 Claims, 8 Drawing Sheets

FUSING SYSTEM INCLUDING A HEAT STORAGE MECHANISM

FIELD OF THE INVENTION

The present disclosure relates to a fusing system including a heat storage mechanism. More particularly, the disclosure relates to a fusing system including a fuser roller that includes a heat transport layer having high thermal capacity.

BACKGROUND OF THE INVENTION

Electrophotographic printing and copying devices typically are provided with fusing systems that serve to thermally fuse a toner image onto a recording medium, such as a sheet of paper. Such fusing systems normally comprise a heated fuser roller and a heated pressure roller that presses against the fuser roller to form a nip in which the fusing occurs. FIG. 1 illustrates a simplified end view of a typical prior art fusing system 100. As indicated in FIG. 1, the fusing system 100 generally comprises a fuser roller 102, a pressure roller 104, internal heating elements 106, and a temperature sensor 108. The fuser and pressure rollers 102 and 104 comprise hollow tubes 110 and 112 that are coated with outer layers 114 and 116 of elastomeric material.

The internal heating elements 106 typically comprise halogen lamps that uniformly irradiate the inner surfaces of the rollers 102 and 104. Through this irradiation, the inner surfaces are heated and this heat diffuses to the outer surfaces of the fuser and pressure rollers 102 and 104 until they reach a temperature sufficient to melt the toner (e.g., approximately between 160° C. to 190° C.). The fuser roller and the pressure rollers 102 and 104 rotate in opposite directions and are urged together so as to form a nip 118 that compresses the outer layers 114 and 116 of the rollers together. The compression of these layers increases the width of the nip 118, which increases the time that the recording medium resides in the nip. The longer the dwell time in the nip 118, the larger the total energy that the toner and recording medium can absorb to melt the toner. Within the nip 118, the toner is melted and fused to the medium by the pressure exerted on it by the two rollers 102 and 104. After the toner has been fused, the recording medium is typically forwarded to a discharge roller (not shown) that conveys the medium to a discharge tray.

The outer layers 114 and 116 are normally constructed of rubber materials (e.g., silicon rubber) that have high thermal resistance and low thermal capacity. These characteristics can be explained with the thermal model 200 shown in FIG. 2. The thermal model 200 represents the thermal characteristics of the fuser roller 102 shown in FIG. 1 as a recording medium (e.g., sheet of paper) passes through the nip 118. As indicated in FIG. 2, the model 200 comprises a circuit that includes a thermal energy source 202 representative of the internal heating element 106. The energy source 202 delivers a constant amount of energy to a thermal capacitor C1 that is representative of the hollow tube 110 of the fuser roller 102. The energy provided by the energy source 202 must overcome the thermal resistance provided by the resistor R1, which represents the outer layer 114. Due to the large thermal resistance of the materials used to construct the outer layer 114, the resistance provided by R1 is very large. In addition, the energy from the source 202 must overcome the thermal resistance of the resistor R2, which represents heat loss due to convection. This energy also reaches a second thermal capacitor C2 representative of the thermal capacitance of the outer layer 110. Due to the low thermal capacity of materials used to construct the outer layer 114, the thermal capacitance of C2 is very small. Finally, the energy encounters the thermal resistance of resistor RL, which represents the thermal load of the recording medium that passes through the nip 118. Heat generated by the passage of the energy through the resistor RL is represented by "+" and "−" in FIG. 2.

As will be appreciated by persons having ordinary skill in the art, the large resistance of the resistor R1 poses an impediment to the transfer of energy from the interior of the fuser roller 102 to the fuser roller outer surface of the outer layer 114. This impediment creates the heat transport delay which is the primary cause of delay in the warming of the fusing system 100. In addition, the small thermal capacity of capacitor C2 means that the outer layer 114 can store little energy. Because of this fact, the energy stored within the outer layer 114 is quickly dissipated as recording media are passed through the nip 118.

In addition to increasing the warm-up time of the fusing system 100, use of conventional fusing systems such as that shown in FIG. 1 can also result in gloss variation along the length of the recording media. As is known in the art, gloss variation relates to the phenomenon in which the gloss of the fused toner changes over the length of the recording medium. This variation is due to the fact that the fuser roller 102 typically has a circumference which is smaller than the length of the recording medium. Therefore, the fuser roller 102 will normally pass through several revolutions as the recording medium passes through the nip 118. Due to the transfer of heat to the medium through each revolution and to the fact that the outer layer 114 cannot store large amounts of thermal energy, the temperature of the outer surface of the fuser roller 102 can drop significantly from the leading edge of the medium to its trailing edge. This can result in the printed recording medium having a first section adjacent its leading edge in which the printed media is highly glossy, a second section at its middle where the printed media has a less glossy finish, and a third section adjacent its trailing edge in which the printed media has a non-glossy (i.e., matte) finish.

Gloss variation is undesirable for several reasons. First, printed materials having gloss variation are unaesthetic in that the printed media have an inconsistent appearance. This is particularly true in the case of color printing or photocopying in that the glossy portions of the printed media will appear more vibrant than less glossy portions. Second, a glossy finish normally indicates better fusing to the recording medium. With good fusing, there will be better adhesion between the toner and the recording medium and therefore less chance of the toner flaking off of the recording medium.

From the foregoing, it can be appreciated that it would be desirable to have a fusing system that avoids one or more of the disadvantages described above associated with conventional fusing systems such as gloss variation.

SUMMARY OF THE INVENTION

The present disclosure relates to a fusing system for fusing toner to a recording medium. The fusing system comprises a fuser roller including an elastomeric layer and a heat transport layer disposed around the elastomeric layer, the heat transport layer having high thermal capacity, and a pressure roller in contact with the fuser roller.

The present disclosure also relates to a fusing method that helps reduce gloss variation of printed media fused to a recording medium with a fusing system. The method comprises the steps of forming a heat transport layer having high thermal capacity at an outer surface of a fuser roller of the fusing system, heating the heat transport layer, and transferring heat from the heat transport layer to the recording medium as it passes through a nip of the fusing system.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 1:
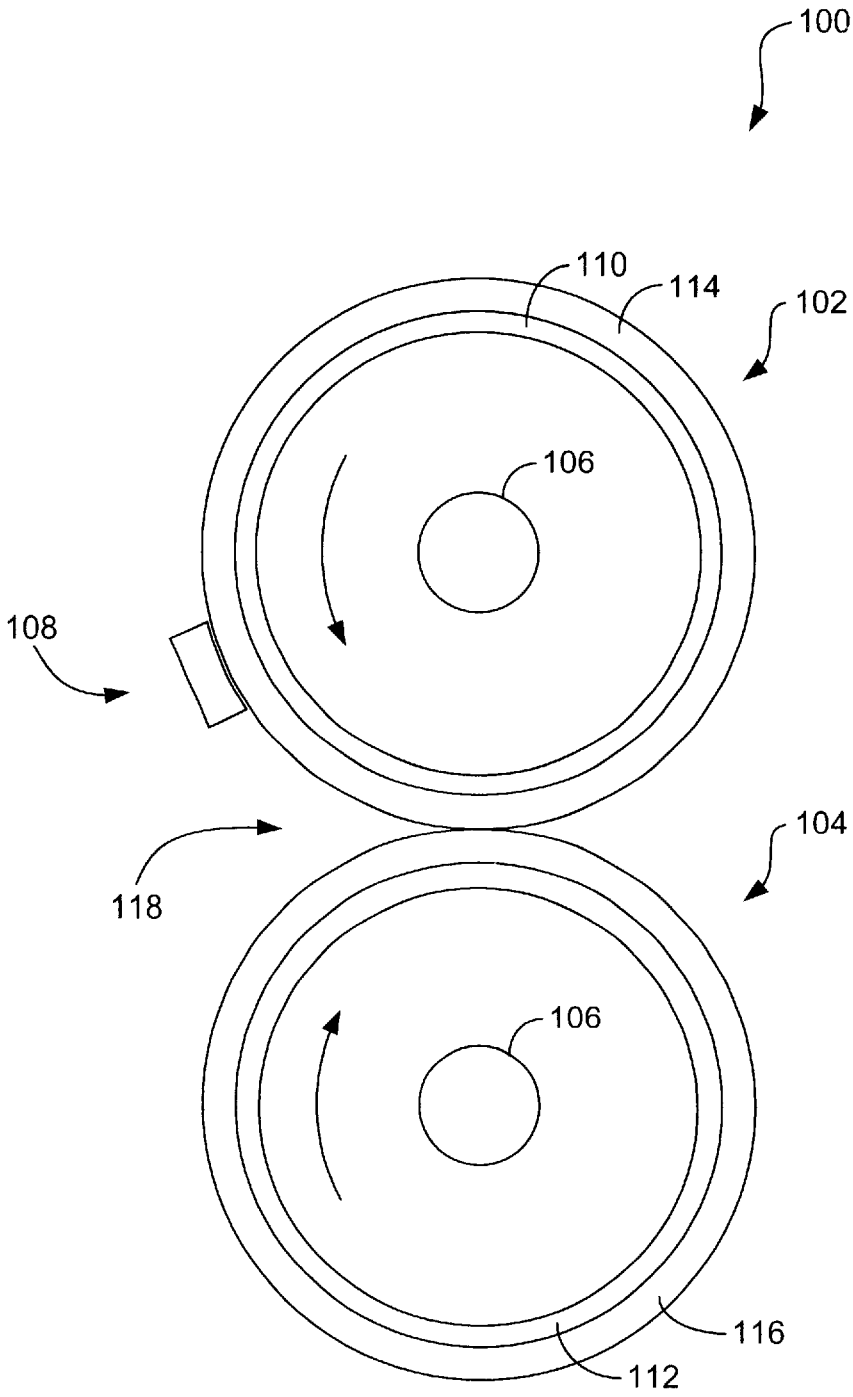
FIG. 1 (PRIOR ART)
FIG. 1 is a simplified end view of a prior art fusing system.
Figure 2:
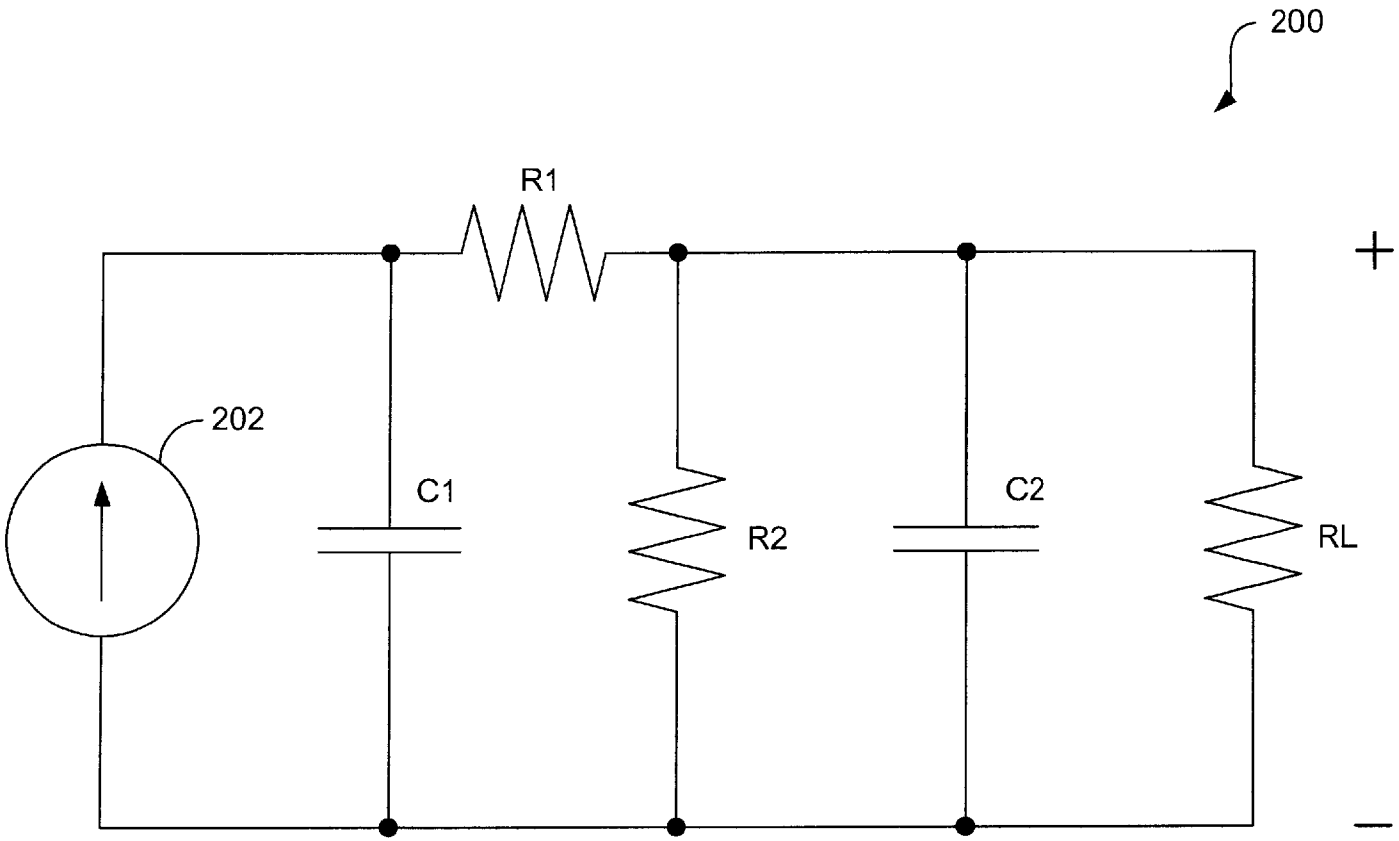
FIG. 2 (PRIOR ART)
FIG. 2 is a thermal model of the fusing system shown in FIG. 1.
Figure 3:
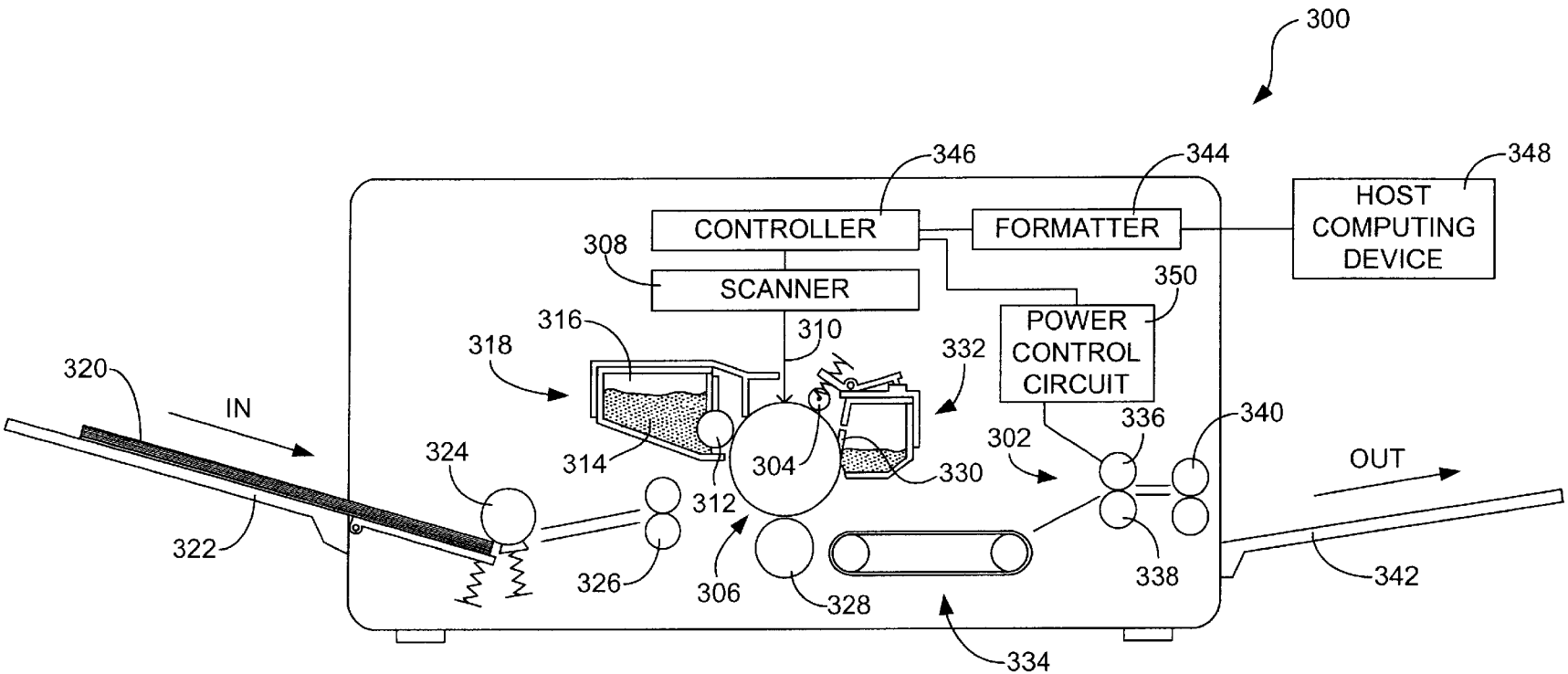
FIG. 3 is a schematic side view of an electrophotographic imaging device incorporating a first fusing system.

Referring now in more detail to the drawings, in which like numerals indicate corresponding parts throughout the several views, FIG. 3 illustrates a schematic side view of an electrophotographic imaging device 300 that incorporates a first fusing system 302. By way of example, the device 300 comprises a laser printer. It is to be understood, however, that the device 300 can, alternatively, comprise any other such imaging device that uses a fusing system including, for instance, a photocopier or a facsimile machine.

As indicated in FIG. 3, the device 300 includes a charge roller 304 that is used to charge the surface of a photoconductor drum 306, to a predetermined voltage. A laser diode (not shown) is provided within a laser scanner 308 that emits a laser beam 310 which is pulsed on and off as it is swept across the surface of the photoconductor drum 306 to selectively discharge the surface of the photoconductor drum. In the orientation shown in FIG. 3, the photoconductor drum 306 rotates in the counterclockwise direction. A developing roller 312 is used to develop a latent electrostatic image residing on the surface of photoconductor drum 306 after the surface voltage of the photoconductor drum has been selectively discharged. Toner 314 is stored in a toner reservoir 316 of an electrophotographic print cartridge 318. The developing roller 312 includes an internal magnet (not shown) that magnetically attracts the toner 314 from the print cartridge 318 to the surface of the developing roller. As the developing roller 312 rotates (clockwise in FIG. 3), the toner 314 is attracted to the surface of the developing roller 312 and is then transferred across the gap between the surface of the photoconductor drum 306 and the surface of the developing roller to develop the latent electrostatic image.

Recording media 320, for instance sheets of paper, are loaded from an input tray 322 by a pickup roller 324 into a conveyance path of the device 300. Each recording medium 320 is individually drawn through the device 300 along the conveyance path by drive rollers 326 such that the leading edge of each recording medium is synchronized with the rotation of the region on the surface of the photoconductor drum 306 that comprises the latent electrostatic image. As the photoconductor drum 306 rotates, the toner adhered to the discharged areas of the drum contacts the recording medium 320, which has been charged by a transfer roller 328, such that the medium attracts the toner particles away from the surface of the photoconductor drum and onto the surface of the medium. Typically, the transfer of toner particles from the surface of the photoconductor drum 306 to the surface of the recording medium 320 is not completely efficient. Therefore, some toner particles remain on the surface of the photoconductor drum. As the photoconductor drum 306 continues to rotate, the toner particles that remain adhered to the drum's surface are removed by a cleaning blade 330 and deposited in a toner waste hopper 332.

As the recording medium 320 moves along the conveyance path past the photoconductor drum 306, a conveyer 334 delivers the recording medium to the fuser system 302. The recording media 320 passes between a fuser roller 336 and a pressure roller 338 of the fusing system 302 that are described in greater detail below. As the pressure roller 338 rotates, the fuser roller 336 is rotated and the recording medium 320 is pulled between the rollers. The heat applied to the recording medium 320 by the fusing system 302 fuses the toner to the surface of the recording medium. Finally, output rollers 340 draw the recording medium 320 out of the fusing system 302 and delivers it to an output tray 342.

As identified in FIG. 3, the device 300 can further include a formatter 344 and a controller 346. The formatter 344 receives print data, such as a display list, vector graphics, or raster print data, from a print driver operating in conjunction with an application program of a separate host computing device 348. The formatter 344 converts the print data into a stream of binary print data and sends it to the controller 346. In addition, the formatter 344 and the controller 346 exchange data necessary for controlling the electrophotographic imaging process. In particular, the- controller 346 supplies the stream of binary print data to the laser scanner 308. The binary print data stream sent to the laser diode within the laser scanner 308 pulses the laser diode to create the latent electrostatic image on the photoconductor drum 306.

In addition to providing the binary print data stream to the laser scanner 308, the controller 346 controls a high voltage power supply (not shown) that supplies voltages and currents to the components used in the device 300 including the charge roller 304, the developing roller 312, and the transfer roller 328. The controller 346 further controls a drive motor (not shown) that drives the printer gear train (not shown) as well as the various clutches and feed rollers (not shown) necessary to move recording media 320 through the conveyance path of the device 300.

A power control circuit 350 controls the application of power to the fusing system 302. In a preferred arrangement, the power control circuit 350 is configured in the manner described in U.S. Pat. Nos. 5,789,723 and 6,018,151, which are hereby incorporated by reference into the present disclosure, such that the power to the fusing system 302 is linearly controlled and the power levels can be smoothly ramped up and down as needed. Such operation provides for better control over the amount of heat generated by the fusing system 302. While the device 300 is waiting to begin processing a print or copying job, the temperature of the fuser roller 336 is kept at a standby temperature corresponding to a standby mode.

In the standby mode, power is supplied at a reduced level to the fuser roller 336 by the power control circuit 350 to reduce power consumption, lower the temperature, and reduce the degradation resulting from continued exposure to the components of the fusing system 302 to the fusing temperatures. The standby temperature of the fuser roller 336 is selected to balance a reduction in component degradation against the time required to heat the fuser roller from the standby temperature to the fusing temperature. From the standby temperature, the fuser roller 336 can be quickly heated to the temperature necessary to fuse toner to the recording media 320. When processing of a fusing job begins, the controller 346, sufficiently ahead of the arrival of a recording medium 320 at the fusing system 302, increases the power supplied by the power control circuit 350 to the fusing system to bring its temperature up to the fusing temperature. After completion of the fusing job, the controller 346 sets the power control circuit 350 to reduce the power supplied to the fusing system 302 to a level corresponding to the standby mode. The cycling of the power supplied to fusing system 302 is ongoing during the operation of device as fusing jobs are received and processed and while the device is idle.

Figure 4:
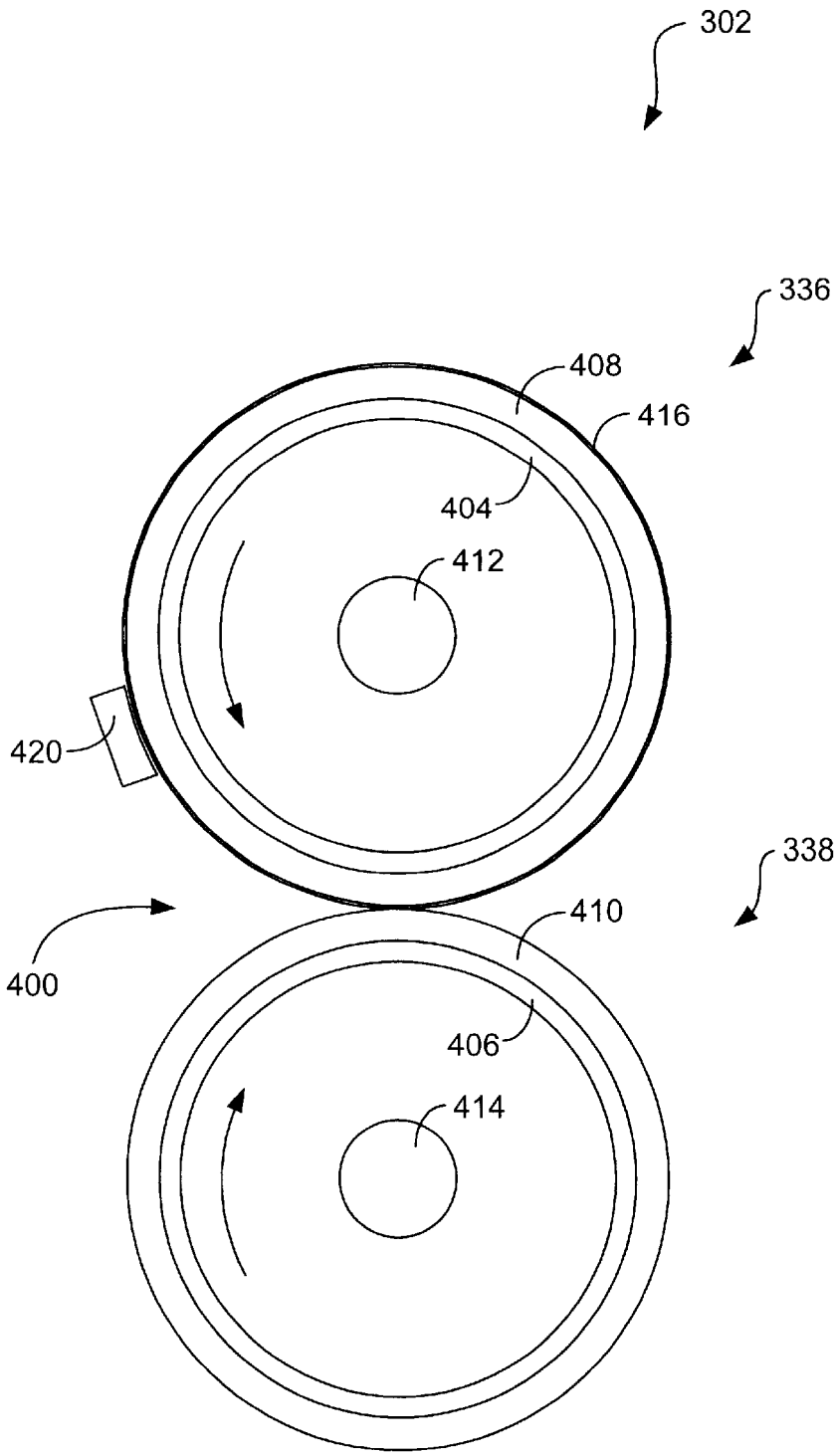
FIG. 4 is a simplified end view of the fusing system shown in FIG. 3.

FIG. 4 illustrates a simplified end view of the fusing system 302 shown in FIG. 3. As indicated in FIG. 4, the fusing system 302 generally comprises the fuser roller 336 and the pressure roller 338 that together form a nip 400 therebetween. The fuser roller 336 and pressure roller 338 typically are formed as hollow tubes 404 and 406. By way of example, each of these tubes 404 and 406 is composed of a metal such as aluminum or steel and has a diameter of approximately 45 millimeters (mm). By further way of example, each tube 404 and 406 has a thickness of approximately 2.5 mm. Each roller 336 and 338 is provided with an elastomeric layer 408 and 410 that is composed of an elastomeric material such as silicon rubber or a flexible thermoplastic. By way of example, the elastomeric layers 408 and 410 are approximately 2 to 5 millimeters (mm) thick.

Inside each of the fuser and pressure rollers 336 and 338 is an internal heating element 412 and 414. By way of example, the internal heating elements 412 and 414 comprise tungsten filament halogen lamps or nichrome heating elements. Normally, the heating elements 412 and 414 are at least as long as the rollers 336 and 338 such that the elements can be fixedly mounted in place. When formed as tungsten filament halogen lamps, the internal heating elements 412 and 414 can have power ratings of, for example, approximately 600 watts (W) and 100 W, respectively. It is to be noted that, although an internal heating element 414 is shown and described, the pressure roller 338 could, alternatively, be configured without its own heat source. Preferably, however, such a heat source is provided to avoid the accumulation of toner on the pressure roller 338 during use.

Figure 5:
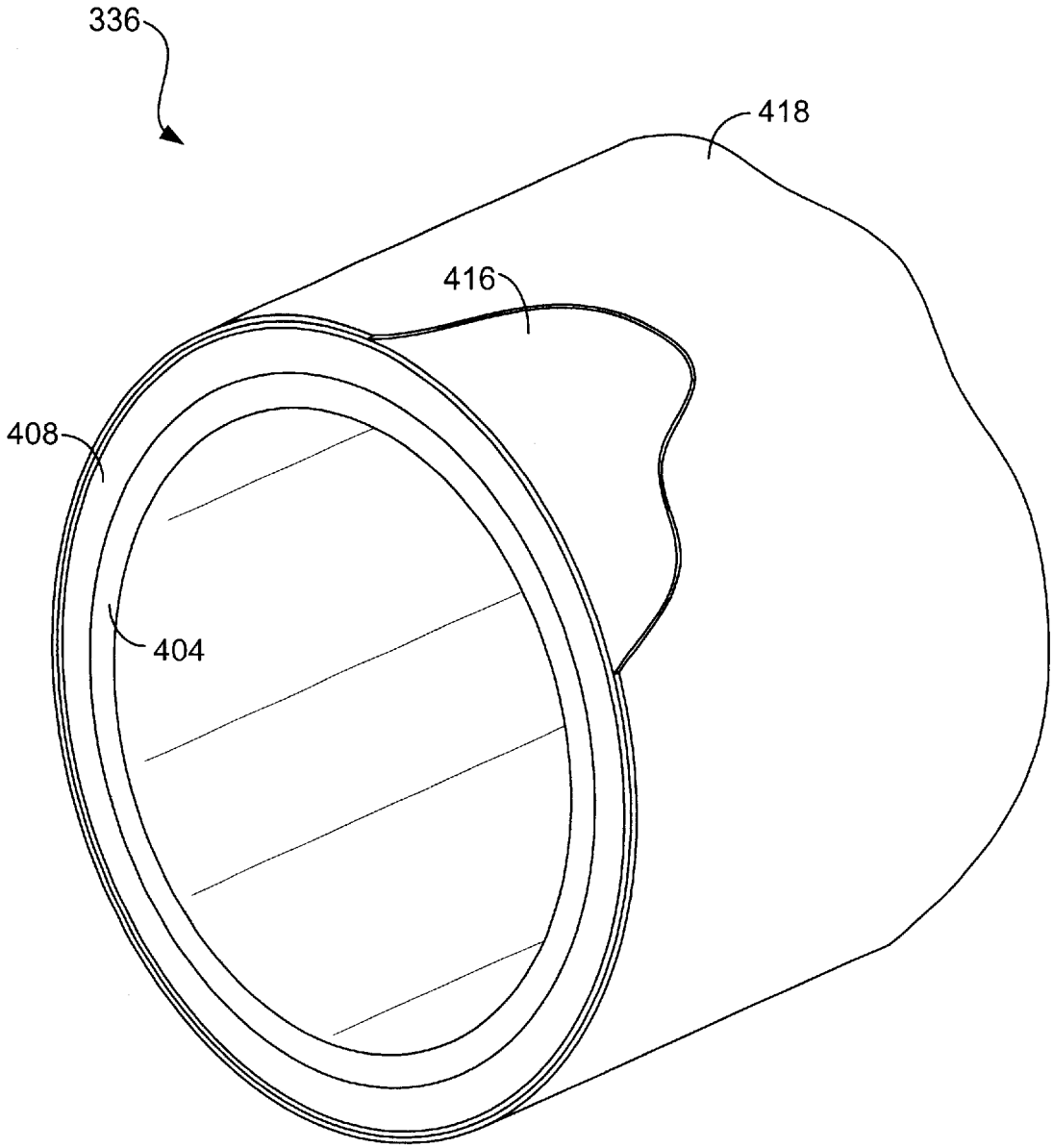
FIG. 5 is a partial perspective view of a fuser roller of the fusing system shown in FIG. 4.

As identified above, the thermal capacity of the roller elastomeric layers 408 and 410 is normally low which can result in gloss variation on the recording media. To avoid this problem, the fuser roller 336 is provided with a heat transport layer 416 that is composed of a material having a large thermal capacity. This layer 416 is shown best in FIG. 5. Typically, the heat transport layer 416 is constructed of a metal such as aluminum, copper, nickel, or steel. By way of example, the heat transport layer 416 can have a thickness of approximately 0.1 mm to 0.2 mm. In one embodiment, the heat transport layer 416 comprises a foil that is wrapped around the elastomeric layer 408. In another embodiment, the transport layer 416 is electrolessly plated to the outer surface of the elastomeric layer 408. In a further embodiment, the heat transport layer 416 is a metal oxide that is powder coated to and cured on the elastomeric layer 408. Irrespective of its configuration, however, the presence of the thermal transport layer 416 greatly increases the thermal capacity at the outer surface of the fuser roller 336. To prevent toner from adhering to the heat transport layer 416, a layer 418 of TEFLON™ (FIG. 5) can be applied to the fuser roller 336. By way of example, the TEFLON™ can comprise a thin film that is heat shrunk onto the heat transport layer 416. Similarly, a layer of TEFLON™ can be applied to the elastomeric layer 410 of the pressure roller 338. These layers of TEFLON™ can, for instance, have a thickness of approximately 1.5 to 2 mils. In an alternative arrangement, the layer 418 can comprise a thin layer of polyimide (e.g., 1 mil thick) covered by a thin layer of TEFLON™ (e.g., 0.5 mil thick).

With reference back to FIG. 4, the fusing system 302 further includes a temperature sensor 420. The temperature sensor 420 can comprise a thermistor that is placed in close proximity to or in contact with the fuser rollers. Alternatively, the sensor 420 can comprise a non-contact thermopile (not shown), if desired. Although a non-contact thermopile is preferable from the standpoint of reliability, such thermopiles are more expensive and therefore increase the cost of the device 300.

In operation, power is supplied to the heating elements 412 and 414, by the control circuit 350 (FIG. 3) so as to heat both of the hollow tubes 404 and 406, with radiated heat. As identified above, heating of the pressure roller 338 is optional in that enough heat may be provided by the internal heating element 412 alone. Relatively moderate heating of the pressure roller 338 is deemed preferable however to avoid the accumulation of toner on the outer layer 410 of the pressure roller. By way of example, power is supplied to the heating elements 412 and 414, such that the fuser and pressure rollers 336 and 338 are maintained at set point temperatures of approximately 185° C. to 195° C.

Figure 6:
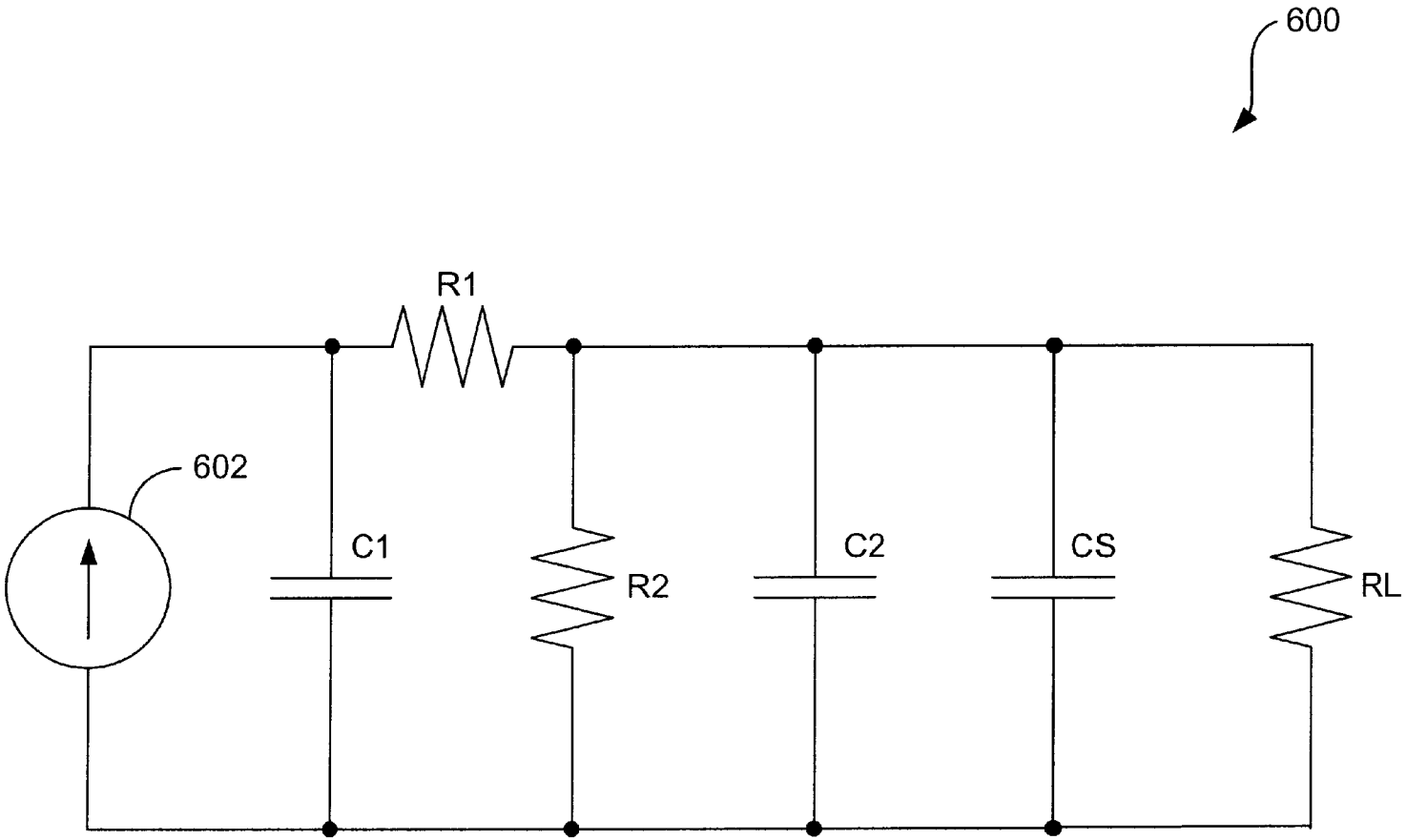
FIG. 6 is a thermal model of the fusing system shown in FIG. 4.

Due to the provision of the heat transfer layer 416, the fuser roller outer layer 408 can store more thermal energy. This fact is illustrated by the thermal model 600 shown in FIG. 6. This thermal model 600 represents the fuser roller 336 shown in FIG. 4 as a recording medium (e.g., sheet of paper) passes through the nip 400. As indicated in FIG. 6, the model 600, like model 200, comprises a circuit that includes a thermal energy source 602 representing the internal heating element 412, a thermal capacitor C1 representing the thermal capacitance of the hollow tube 404, a resistor R1 representing the elastomeric layer 408, a resistor R2 representing heat loss due to convection, a second thermal capacitor C2 representing the thermal capacitance of the elastomeric layer, and a resistor RL that represents the thermal load of the recording medium that passes through the nip. Notably, the TEFLON™ layer 418 (FIG. 5) is not represented in that its effect on the thermal characteristics of the fuser roller 336 is negligible with its dimensions recited above. In the model 600 shown in FIG. 6, however, the circuit further includes a third thermal capacitor CS representing the thermal capacitance ("storage") of the heat transport layer 416. Unlike C2, CS is very large, for instance several orders of magnitude greater than C2. Therefore, a much larger amount of heat energy can be maintained at the outer surface of the fuser roller 336. Accordingly, the fuser roller 336 can transfer more heat energy to the recording media passing through the nip 400 to reduce gloss variation of the printed media fused thereto.

Figure 7:
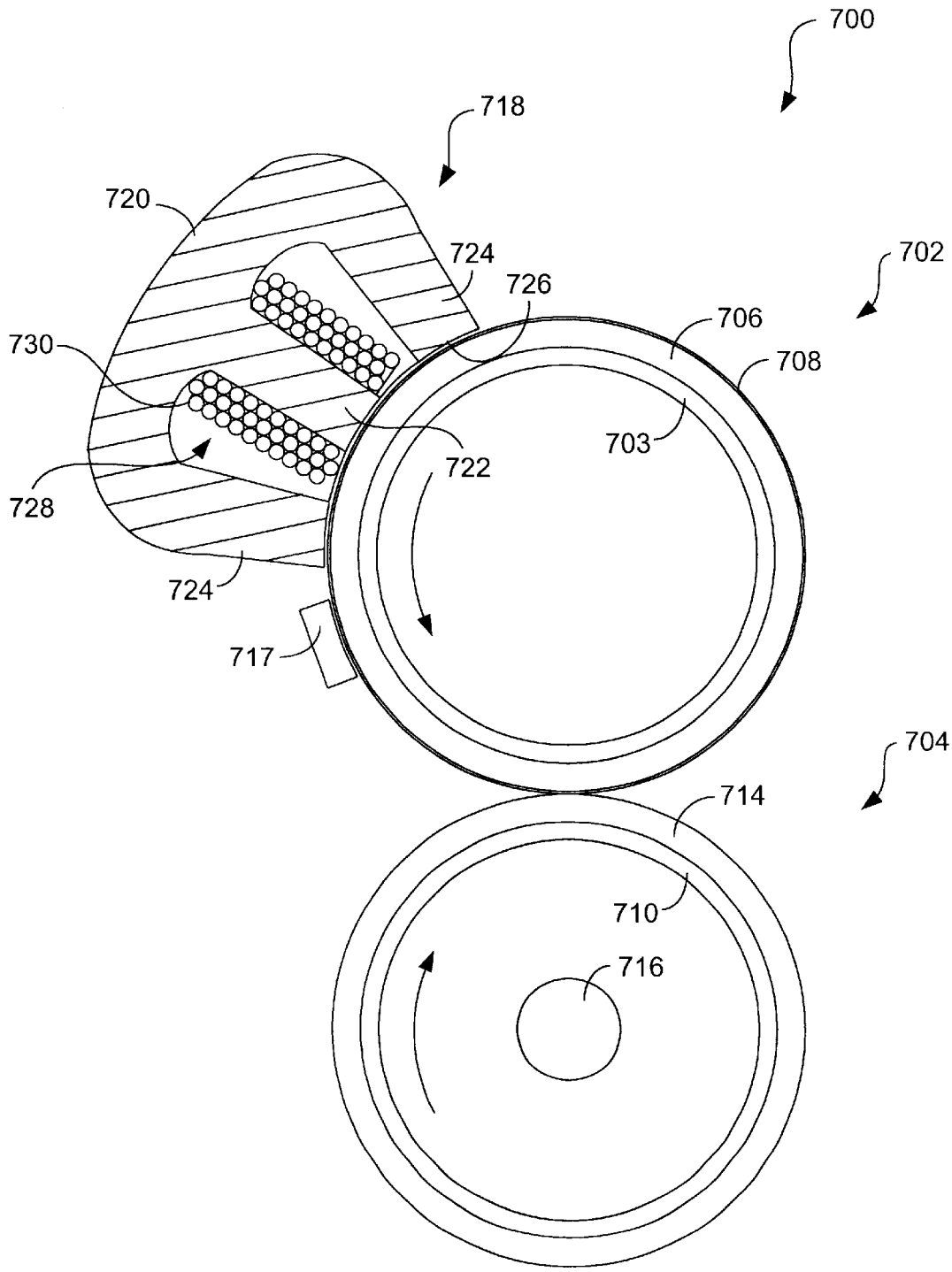
FIG. 7 is a simplified end view of a second fusing system.
Figure 8:
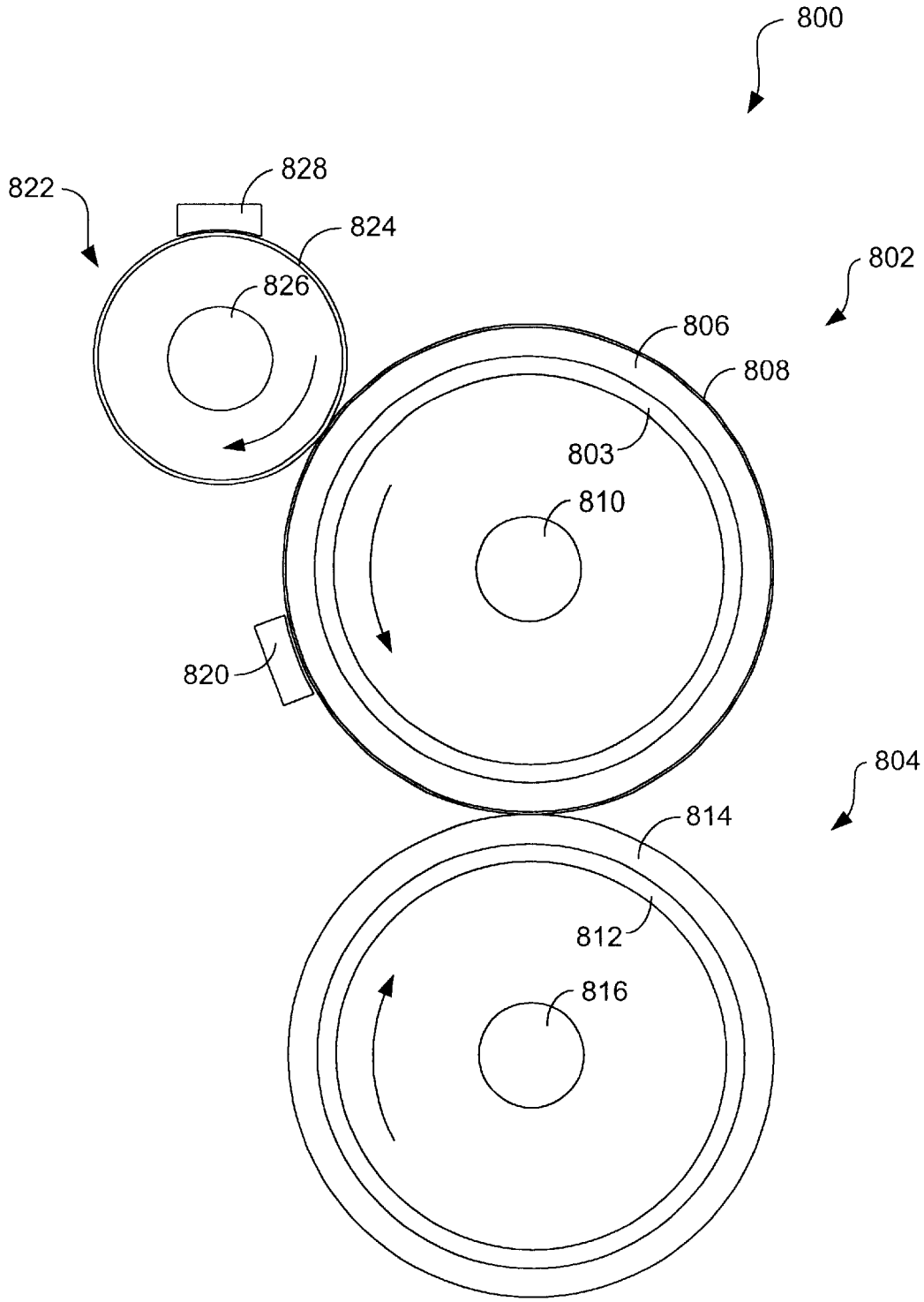
FIG. 8 is a simplified end view of a third fusing system.

As discussed above, the elastomeric material used to form the elastomeric layers of the fuser and pressure rollers in most fusing systems also has low thermal conductivity. Therefore, even though a fuser roller includes a heat transport layer having high thermal capacity, re-heating of the heat transport layer can be delayed due to the elastomeric material's low thermal conductivity. Therefore, the most advantageous results occur where the fusing system includes a fuser roller having an outer heat transport layer, as well as a heat source external to the fuser roller such that the heat transport layer can be directly heated. FIGS. 7 and 8 illustrate two example arrangements in which the heat transport layer is externally heated in this manner.

With reference first to FIG. 7, illustrated is a second fusing system 700. As indicated in this figure, the fusing system 700 is similar in construction to that shown in FIG. 4. Therefore, the fusing system 700 includes a fuser roller 702 including a 703, an elastomeric layer 706, and a heat transport layer 708. The fusing system 700 further includes a pressure roller 704 that includes a hollow tube 71 0, elastomeric layer 714, and an internal heating element 716. In addition, provided is a temperature sensor 717. However, in the embodiment shown in FIG. 7, the fuser roller 702 is not internally heated but is instead externally heated with an external induction heating element 718.

The external induction heating element 718 is positioned in close proximity to the fuser roller 702 and, by way of example, is placed at the ten o'clock position. Although this positioning is shown and described, persons having ordinary skill in the art will appreciate that alternative placement is feasible. The external induction heating element 718 generally comprises a pole member 720 that includes a central pole 722 and opposed flux concentrators 724. As is apparent in FIG. 7, the central pole 722 and the flux concentrators 724 together form a concave surface 726 that preferably has a radius of curvature that closely approximates the radius of the fuser roller 702 such that a very small gap, e.g. between approximately 1 mm and 2 mm in width, is formed between the external induction heating element 718 and the fuser roller. The external induction heating element 718 further includes a coil 728 that is wrapped around the central pole 722. The coil 728 comprises a plurality of turns of a continuous conductive wire 730. In a preferred arrangement, the wire 730 comprises a copper Litz wire.

During operation of the fusing system 700, high frequency, e.g. approximately 10 kHz to 100 Hz, current is delivered by the power control circuit 350 (FIG. 3) to the coil 728. As the current flows through the coil 728, high frequency magnetic fluxes are generated in the central pole 722 of the pole member 720. Due to the arrangement of the external induction heating element 718 and the fuser roller 702, the magnetic fluxes are focused upon the fuser roller and, therefore, upon the metal heat transport layer 708 of the fuser roller. The magnetic fluxes travel inside the heat transport layer 708 and cause it to produce induced eddy currents that generate heat, thereby heating the fuser roller 702.

With reference now to FIG. 8, illustrated is a third fusing system 800. As indicated in this figure, the fusing system 800 again is similar in construction to that shown in FIG. 4. Therefore, the fusing system 800 includes a fuser roller 802 including a hollow tube 803, an elastomeric layer 806, a heat transport layer 808, and an internal heating element 810. In addition, the pressure roller 804 comprises a hollow tube 812, an elastomeric layer 814, and an internal heating element 816. However, in the embodiment of FIG. 8, the fuser roller 802 is not only internally heated but is also externally heated with an external heating roller 822.

As indicated in FIG. 8, the external heating roller 822 comprises a hollow tube 824. The hollow tube 824 typically is composed of a metal such as aluminum or steel. To avoid a substantial increase in the height dimension of the fusing system 800, the tube 824 preferably has a relatively small diameter, e.g. approximately 1 in. In addition, the external heating roller 822 is preferably arranged at approximately the ten o'clock position relative to the fuser roller 802. Although such positioning of the external heating roller 822 is shown and described, persons having ordinary skill in the art will appreciate that alternative placement is feasible. The tube 824 can be much thinner than the tubes 804 and 812 in that the external heating roller 822 is not compressed to form a nip. By way of example, this thickness can be approximately 0.03 in. Formed on the exterior of the hollow tube 824 is a layer of TEFLON™ (not visible in FIG. 8) that, for instance, has a thickness of approximately 1.5 to 2 mils. Like the fuser roller 802, the external heating roller 822 normally comprises an internal heating element 826 that, by way of example, comprises a tungsten filament halogen lamp or a nichrome heating element. When formed as tungsten filament halogen lamp, the internal heating element 826 can have a power rating of, for example, approximately 500 W. Also provided in the fusing system 800 is a second temperature sensor 828.

In operation, power is supplied to the heating elements 810, 816 (if provided), and 826 by the control circuit 150 so as to heat each of the rollers 802, 812, and 822, respectively. It is to be noted that heating of the pressure roller 804 is optional in that enough heat may be provided by the internal heating elements 810 and 826 alone. Relatively moderate heating of the pressure roller 804 is deemed preferable however to avoid the accumulation of toner on the elastomeric layer 814 of the pressure roller. By way of example, power is supplied to the heating elements 810, 816, and 826 such that the fuser and pressure rollers 802 and 804 are maintained at set point temperatures of approximately 185° C. to 195° C., and the external heating roller 822 is maintained at a set point temperature of approximately 220° C. to 240° C. In order to more precisely control heating and avoid temperature overshoot, the temperature of the fuser roller 802 and the external heating roller 822 are each preferably monitored individually with the separate temperature sensors 820 and 828 such that the power supplied to each of the heating elements 810 and 826 can be individually controlled. By way of example, this control can be provided with point controllers of the power control circuit 350.

While particular embodiments of the invention have been disclosed in detail in the foregoing description and drawings for purposes of example, it will be understood by those skilled in the art that variations and modifications thereof can be made without departing from the scope of the invention as set forth in the following claims.

What is claimed is:

1. A fusing system for fusing toner to a recording medium, comprising:

a fuser roller including an inner tube, an elastomeric layer disposed about the inner tube, and a heat transport layer formed on the elastomeric layer, the heat transport layer being composed solely of a metal having high thermal capacity; and a pressure roller in contact with the fuser roller.

2. The system of claim 1, wherein the heat transport layer is approximately 0.1 mm to 0.2 mm thick.

3. The system of claim 1, wherein the heat transport layer comprises a foil that is disposed around the elastomeric layer.

4. The system of claim 1, wherein the heat transport layer is electrolessly plated to the elastomeric layer.

5. The system of claim 1, wherein the heat transport layer is powder coated to the elastomeric layer.

6. The system of claim 1, further comprising an internal heating element disposed within the fuser roller.

7. The system of claim 1, further comprising an induction heating element positioned in close proximity with an outer surface of the fuser roller.

8. The system of claim 1, further comprising a heating roller in contact with an outer surface of the fuser roller.

9. The fusing system of claim 1, wherein the heat transport layer is greater than 0.1 mm thick.

10. A fuser roller for use in a fusing system, comprising:

an inner metal tube;

an elastomeric layer disposed around the inner metal tube; and a heat transport layer disposed around the elastomeric layer, the heat transport layer being composed solely of a metal having a high thermal capacity.

11. The roller of claim 10, wherein the heat transport layer is approximately 0.1 mm to 0.2 mm thick.

12. The roller of claim 10, wherein the heat transport layer comprises a foil that is disposed around the elastomeric layer.

13. The roller of claim 10, wherein the heat transport layer is electrolessly plated to the elastomeric layer.

14. The roller of claim 10, wherein the heat transport layer is powder coated to the elastomeric layer.

15. The fuser roller of claim 10, wherein the heat transport layer is greater than 0.1 mm thick.

16. A device in which toner is fused to a recording medium, comprising:

means for attracting toner to a surface of the recording medium; and a fusing system comprising a fuser roller including an elastomeric layer and a heat transport layer formed on the elastomeric layer, the heat transport layer being composed solely of a metal having high thermal capacity, and a pressure roller in contact with the fuser roller.

17. The device of claim 16, wherein the heat transport layer is approximately 0.1 mm to 0.2 mm thick.

18. The device of claim 16, wherein the heat transport layer comprises a foil that is disposed around the elastomeric layer.

19. The device of claim 16, wherein the heat transport layer is electrolessly elastomeric layer.

20. The device of claim 16, wherein the heat transport layer is powder elastomeric layer.

21. The device of claim 16, wherein the heat transport layer is greater than 0.1 mm thick.

22. A fusing system for fusing toner to a recording medium, comprising:

a fuser roller including an elastomeric layer and a heat transport layer formed on the elastomeric layer, the heat transport layer comprising a metal foil having high thermal capacity; and a pressure roller in contact with the fuser roller.

23. A fusing system for fusing toner to a recording medium, comprising:

a fuser roller including an elastomeric layer and a heat transport layer formed on the elastomeric layer, the heat transport layer comprising an electrolessly plated metal layer having high thermal capacity; and a pressure roller in contact with the fuser roller.

24. A fusing system for fusing toner to a recording medium, comprising:

a fuser roller including an elastomeric layer and a heat transport layer formed on the elastomeric layer, the heat transport layer comprising a powder coated metal layer having high thermal capacity; and a pressure roller in contact with the fuser roller.

* * * * *

UNITED STATES PATENT AND TRADEMARK OFFICE

CERTIFICATE OF CORRECTION

PATENT NO. : 6,512,913 B2
DATED : January 28, 2003
INVENTOR(S) : Hirst et al.

It is certified that error appears in the above-identified patent and that said Letters Patent is hereby corrected as shown below:

Column 10,
Line 10, after "electrolessly" and before "elastomeric", insert -- plated to the --.
Line 12, after "powder" and before "elastomeric", insert -- coated to the --.

Signed and Sealed this

Sixteenth Day of December, 2003

JAMES E. ROGAN
*Director of the United States Patent and Trademark Office*